US007935180B2

(12) United States Patent
Weber

(10) Patent No.: US 7,935,180 B2
(45) Date of Patent: May 3, 2011

(54) REMOVING NON-CONDENSABLE GAS FROM A SUBAMBIENT COOLING SYSTEM

(75) Inventor: Richard M. Weber, Prosper, TX (US)

(73) Assignee: Raytheon Company, Waltham, MA (US)

( * ) Notice: Subject to any disclaimer, the term of this patent is extended or adjusted under 35 U.S.C. 154(b) by 273 days.

(21) Appl. No.: 12/249,344

(22) Filed: Oct. 10, 2008

(65) Prior Publication Data

US 2010/0089461 A1 Apr. 15, 2010

(51) Int. Cl.
*B01D 53/00* (2006.01)

(52) U.S. Cl. ..... 95/288; 62/495

(58) Field of Classification Search ..... 95/288; 165/301, 302; 62/495
See application file for complete search history.

(56) References Cited

U.S. PATENT DOCUMENTS

| | | | | |
|---|---|---|---|---|
| 4,484,453 | A | 11/1984 | Niess | |
| 4,531,375 | A | 7/1985 | Zinsmeyer | |
| 4,926,659 | A * | 5/1990 | Christensen et al. | 62/476 |
| 6,957,550 | B2 | 10/2005 | Wyatt et al. | 62/475 |

FOREIGN PATENT DOCUMENTS

| | | |
|---|---|---|
| DE | 35 17 220 | 11/1985 |
| GB | 2 276 229 | 9/1994 |
| JP | 54 054355 A | 4/1979 |
| JP | 01 088074 A | 4/1989 |
| JP | 03 001058 A | 1/1991 |

OTHER PUBLICATIONS

William G. Wyatt, U.S. Appl. No. 12/233,905, filed Sep. 19, 2008, entitled *Sensing and Estimating In-Leakage Air in a Subambient Cooling System*.

PCT, Notification of Transmittal of the International Search Report and the Written Opinion of the International Searching Authority, or the Declaration, International Application No. PCT/US2009/056437 filed Sep. 10, 2009 (13 pages), Mar. 10, 2010.

* cited by examiner

*Primary Examiner* — Robert A Hopkins
(74) *Attorney, Agent, or Firm* — Baker Botts L.L.P.

(57) ABSTRACT

In certain embodiments, removing non-condensable gas from a cooling system includes trapping contents of a discharge tube of a heat exchanger, where the heat exchanger is in thermal communication with an ambient environment at an ambient temperature. The contents of the discharge tube comprises a vapor portion of a cooling fluid, a liquid portion of the cooling fluid, and a non-condensable gas. The cooling fluid is at a subambient pressure, and the ambient temperature is lower than a boiling point of the cooling fluid. A first additional portion of the cooling fluid is inlet into the discharge tube to increase a pressure within the discharge tube. The vapor portion of the cooling fluid within the discharge tube is allowed to condense. A second additional portion of the cooling fluid is inlet to purge the non-condensable gas from the discharge tube.

22 Claims, 5 Drawing Sheets

REMOVING NON-CONDENSABLE GAS FROM A SUBAMBIENT COOLING SYSTEM

TECHNICAL FIELD OF THE DISCLOSURE

The present invention relates generally to the field of cooling systems and, more particularly, to removing non-condensable gas from a cooling system loop that operates below ambient pressure (subambient cooling systems).

BACKGROUND OF THE DISCLOSURE

A variety of different structures can generate thermal energy during operation. To prevent such structures from over-heating, a variety of different types of cooling systems may be utilized to dissipate the thermal energy including cooling systems using a coolant loop that operates below ambient pressure (subambient cooling systems). In some subambient cooling systems, leaks into the system may occur.

SUMMARY OF THE DISCLOSURE

In accordance with the present invention, disadvantages and problems associated with previous techniques for keyword searching may be reduced or eliminated.

In certain embodiments, a method for removing non-condensable gas from a cooling system includes trapping contents of a discharge tube of a heat exchanger, where the heat exchanger is in thermal communication with an ambient environment at an ambient temperature. The contents of the discharge tube comprises a vapor portion of a cooling fluid, a liquid portion of the cooling fluid, and a non-condensable gas. The cooling fluid is at a subambient pressure, and the ambient temperature is lower than a boiling point of the cooling fluid. A first additional portion of the cooling fluid is inlet into the discharge tube to increase a pressure within the discharge tube. The vapor portion of the cooling fluid within the discharge tube is allowed to condense. A second additional portion of the cooling fluid is inlet to purge the non-condensable gas from the discharge tube.

In certain embodiments, a system for removing non-condensable gas from a cooling system includes a discharge tube of a heat exchanger and one or more valves associated with the discharge tube. The heat exchanger is in thermal communication with an ambient environment at an ambient temperature. The contents of the discharge tube comprises a vapor portion of a cooling fluid, a liquid portion of the cooling fluid, and a volume of non-condensable gas. The cooling fluid is at a subambient pressure, and the ambient temperature is lower than a boiling point of the cooling fluid. The one or more valves are configured to: trap the contents of the discharge tube, inlet a first additional portion of the cooling fluid into the discharge tube to increase a pressure within the discharge tube, allow the vapor portion of the cooling fluid within the discharge tube to condense, and inlet a second additional portion of the cooling fluid into the discharge tube to purge the non-condensable gas.

Accordingly, an improved, more efficient system related to subambient cooling system (SACS) operation is disclosed. Teachings of some embodiments of the disclosure recognize a system for removing in-leakage air trapped in a SACS. Certain embodiments may accommodate a variable level of liquid coolant in a condensing heat exchanger. In certain embodiments, no coolant from an SACS loop is removed, other than that which is in the form of humidity in the removed air. Certain embodiments disclose automated removal of in-leakage air. Certain embodiments disclose removal of in-leakage air without disrupting operation of an SACS. Additionally, certain embodiments allow modules with internal cooling passages (e.g., transmit-receive integrated microwave modules used in systems such as phased array radars) to be removed and installed in a SACS without the need to manually purge a cooling loop of air.

Teachings of some embodiments of the disclosure recognize an air-removal system for a SACS that compensates for circumstances when a heat sink (e.g., ambient temperature) and heat load reach various levels. An advantage of certain embodiments is that in-leakage air may be removed from a SACS regardless of the location and/or size of an air-rich zone within SACS tubes. Additionally, certain disclosed embodiments provide for a system for removing non-condensable gases from cooling system under changing and varied operating conditions. Teachings of some embodiments of the disclosure recognize an air-removal system that accounts for variable heat loads, variable heat sinks, and/or an unknown volume of in-leakage air within a condensing heat exchanger.

BRIEF DESCRIPTION OF THE DRAWINGS

For a more complete understanding of example embodiments of the present disclosure and its advantages, reference is now made to the following description, taken in conjunction with the accompanying drawings, in which.

DETAILED DESCRIPTION

It should be understood at the outset that although example embodiments of the present disclosure are illustrated below, the present disclosure may be implemented using any number of techniques, whether currently known or in existence. The present disclosure should in no way be limited to the example embodiments, drawings, and techniques illustrated below, including the embodiments and implementation illustrated and described herein. Additionally, the drawings are not necessarily drawn to scale.

Subambient cooling systems (SACSs) generally include a closed loop of fluid with an evaporator, a condenser, and a pump. An evaporator boils the liquid and feeds the liquid/vapor mixture to the condenser. A condenser removes heat (thermal energy) while condensing the vapor, and feeds the condensed liquid to the pump. A pump then returns the liquid to the evaporator to complete the loop. The evaporator absorbs heat (thermal energy) from a source such as hot electronics and the condenser transfers heat to a cooling source such as ambient air or water.

A SACS may be designed to transfer heat by forced, two-phase boiling from a higher temperature heat source to a lower temperature heat sink. A SACS involves lowering pressure in a coolant loop below an ambient pressure in order to promote boiling at lower temperatures. One advantage of such as system is that, because the cooling loop is at a subambient pressure, coolant does not have a tendency to leak out of the loop.

Difficulties may arise in a SACS, such as in the case of a SACS with a two-phase coolant, non-condensable gases such as air ("in-leakage air") may leak into the loop and become present in the coolant. Such leaks may occur, for example, as a result of damage to a SACS, aging seals, or fitting problems. In-leakage air may also enter a SACS when integrated modules associated with a SACS are removed, repaired, or installed. In-leakage air may disrupt operation of a SACS by, for example, lowering efficiency of the system and/or decreasing its cooling capacity.

Accordingly, an improved, more efficient system related to SACS operation is disclosed. Teachings of some embodiments of the disclosure recognize a system for removing in-leakage air trapped in a SACS. Certain embodiments may accommodate a variable level of the liquid coolant in the condensing heat exchanger. In certain embodiments, no coolant from a SACS loop is removed, other than that which is in the form of humidity in the removed air. Certain embodiments disclose automated removal of in-leakage air. Certain embodiments disclose removal of in-leakage air without disrupting operation of a SACS. Additionally, certain embodiments allow modules with internal cooling passages (e.g., transmit-receive integrated microwave modules used in systems such as phased array radars) to be removed and installed in a SACS without the need to manually purge a cooling loop of air.

Figure 1:
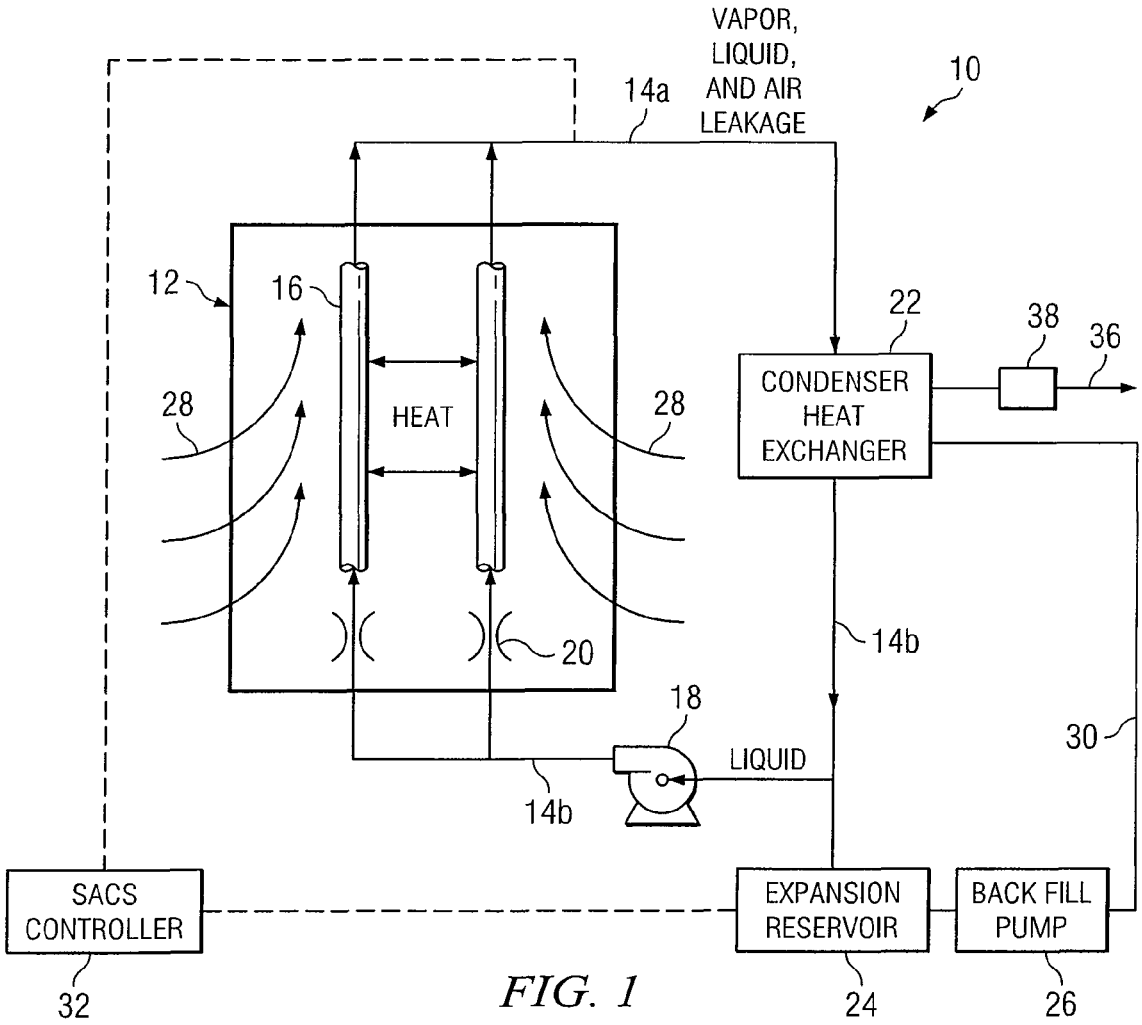
FIG. 1 illustrates one embodiment of a system for removing non-condensable gas from a subambient cooling system.

FIG. 1 is a block diagram of an embodiment of a cooling system 10 that may be utilized in conjunction with other embodiments. Although the details of one cooling system will be described below, it should be expressly understood that other cooling systems may be used in conjunction with embodiments of the disclosure.

Cooling system 10 of FIG. 1 is shown cooling a structure 12 that is exposed to or generates thermal energy. Structure 12 may be any of a variety of structures, including, but not limited to, electronic components, circuits, computers, and servers. Because structure 12 can vary greatly, the details of structure 12 are not illustrated and described. Cooling system 10 of FIG. 1 may include a coolant loop 14 including a vapor line 14*a* and a liquid line 14*b*, evaporators 16, a pump 18, inlet orifices 20, a condenser heat exchanger 22, an air release line 36, an air release valve 38, an expansion reservoir 24, a back fill pump 26, and a SACS controller 32.

Structure 12 may be arranged and designed to conduct heat (thermal energy) to evaporators 16. To receive this thermal energy, or heat, evaporator 16 may be disposed on an edge of structure 12 (e.g., as a thermosyphon, heat pipe, or other device) or may extend through portions of structure 12, for example, through a thermal plane of structure 12. In particular embodiments, evaporators 16 may extend up to the components of structure 12, directly receiving thermal energy from the components. Although two evaporators 16 are shown in cooling system 10 of FIG. 1, one evaporator or more than two evaporators may be used to cool structure 12 in other cooling systems.

In operation, a fluid coolant flows into each of evaporators 16. The fluid coolant may be a two-phase fluid coolant, which enters evaporators 16 in liquid form. Absorption of heat from structure 12 may cause part or all of the liquid coolant to boil and vaporize such that some or all of the fluid coolant leaves evaporators 16 in a vapor phase. To facilitate such absorption or transfer of thermal energy, evaporators 16 may be lined with pin fins or other similar devices which, among other things, increase surface contact between the fluid coolant and walls of evaporators 16.

Additionally, in particular embodiments, the fluid coolant may be forced or sprayed into evaporators 16 to ensure fluid contact between the fluid coolant and the walls of evaporators 16.

Vaporized coolant departs evaporators 16 and may flow through the vapor line 14*a* to condenser heat exchanger 22. Condensed coolant may flow to expansion reservoir 24, back fill pump 26, and back fill line 30. Pump 18 may cause the fluid coolant to circulate around the loop shown in FIG. 1. In particular embodiments, pump 18 may use magnetic drives that do not require seals, which can wear or leak with time. Although vapor line 14*a* uses the term "vapor" vapor line 14*a* may contain some liquid. In certain embodiments, vapor line 14*a* may contain some vapor, some liquid, and/or in-leakage air.

Turning now in more detail to the fluid coolant, one highly efficient technique for removing heat from a surface is to boil and vaporize a liquid, a fluid coolant, that is in contact with a surface. As the liquid vaporizes in this process, it inherently absorbs heat to effectuate such vaporization. The amount of heat that can be absorbed per unit volume of a liquid is commonly known as the "latent heat of vaporization" of the liquid. The higher the latent heat of vaporization, the larger the amount of heat that can be absorbed per unit volume of liquid being vaporized.

The fluid coolant used in the embodiment of FIG. 1 may include, but is not limited to, mixtures of antifreeze and water or water alone. In particular embodiments, the antifreeze may be ethylene glycol, propylene glycol, methanol, or other suitable antifreeze. In other embodiments, the mixture may also include fluoroinert.

Water boils at a temperature of approximately 100° C. at an atmospheric pressure of 14.7 pounds per square inch absolute (psia). In particular embodiments, the fluid coolant's boiling temperature may be reduced to between 55-65° C. by subjecting the fluid coolant to a subambient pressure, for example, a pressure between 1-4 psia, such as 2.3 psia.

Turning now in more detail to system 10, orifices 20 in particular embodiments may facilitate proper partitioning of the fluid coolant among the respective evaporators 16, and may also help to create a large pressure drop between the output of pump 18 and evaporator 16 in which the fluid coolant vaporizes. Orifices 20 may permit the pressure of the fluid coolant downstream from them to be substantially less than the fluid coolant pressure between pump 18 and orifices 20, which in this embodiment is shown as approximately 12 psia. Orifices 20 may have the same size or may have different sizes in order to partition the coolant in a proportional manner that facilitates a desired cooling profile.

In particular embodiments, fluid coolant flowing from pump 18 to orifices 20 through liquid line 14*b* may have a temperature of approximately 55° C to 65° C. and a pressure of approximately 12 psia as referenced above. After passing through orifices 20, the fluid coolant may still have a temperature of approximately 55° C. to 65° C., but may also have a lower pressure in the range about 2 psia to 3 psia. Due to this reduced pressure, some or all of the fluid coolant may boil or vaporize as it passes through and absorbs heat from evaporator 16.

After exiting evaporator 16, coolant vapor travels through vapor line 14*a* to condenser heat exchanger 22, where heat, or thermal energy, can be transferred away from the loop as the vapor condenses. At this point, the fluid coolant may have a temperature of approximately 55° C. to 65° C. and a subambient pressure of approximately 2 psia to 3 psia. The fluid coolant may then flow to pump 18, which in particular embodiments may increase the pressure of the fluid coolant to a value in the range of approximately 12 psia. In particular embodiments, a flow of fluid may be forced to flow through condenser heat exchanger 22, for example by a fan (not shown) or other suitable device. In particular embodiments, the fluid may be ambient air. Condenser heat exchanger 22 may transfer heat from the fluid coolant to the flow of fluid, thereby causing any portion of the coolant that is in the vapor phase to condense back into a liquid phase. In particular embodiments, evaporator 16 may be a cooling tower.

Fluid coolant exiting condenser heat exchanger 22 may be supplied to expansion reservoir 24. Since fluids typically take up more volume in their vapor phase than in their liquid phase, expansion reservoir 24 may be provided in order to take up the volume of liquid fluid coolant that is displaced when a portion of the coolant in the system changes from its liquid phase to its vapor phase. Expansion reservoir 24, in conjunction with SACS controller 32, can control the pressure within the cooling loop. The amount of fluid coolant in its vapor phase may vary over time, due in part to the fact that the amount of heat or thermal energy being produced by structure 12 may vary over time, as structure 12 system operates in various operational modes. In some embodiments, back fill pump 26 may pump coolant from expansion reservoir 24 into an SACS (e.g., into condensing heat exchanger 22) via back fill line 30.

SACS controller 32 may maintain the coolant at a subambient pressure of approximately 1-4 psia (e.g., 2-3 psia), along the portion of the loop which extends from orifices 20 to pump 18, in particular through evaporators 16, condenser heat exchanger 22, and expansion reservoir 24. In particular embodiments, a metal bellows may be used in expansion reservoir 24, connected to the loop using brazed joints. In particular embodiments, SACS controller 32 may control loop pressure by using a motor driven linear actuator that is part of the metal bellows of expansion reservoir 24 or by using small gear pump to evacuate the loop to the desired pressure level. The fluid coolant removed may be stored in the metal bellows whose fluid connects are brazed. In other configurations, SACS controller 32 may utilize other suitable devices capable of controlling pressure. Although specific pressure and temperature measurements are mentioned in the present disclosure, it is explicitly noted that various embodiments may implement and/or operate under pressures and temperatures greater to or less than those specifically mentioned. SACS controller 32 may comprise a computing device with an interface, logic, memory, and/or processing capabilities.

In certain embodiments, ambient air (in-leakage air) 28 may enter a SACS through various means. For example, air may enter a SACS through valve or component fittings, or through leaks caused by damage, decay, repair, or use. Although FIG. 1 illustrates air 28 entering via evaporators 16, it is explicitly noted that air may enter the SACS loop in other ways.

In certain embodiments, an air release line 36 may be coupled to condenser heat exchanger 22 for removal of in-leakage air 28 from system 10. An air release valve 38 may be selectively opened and closed to allow in-leakage air to flow through air release line 26 to the atmosphere or ambient environment.

In certain embodiments, as described in more detail below, a back fill pump 26 may be disposed between coolant line 14 and condenser heat exchanger 22 to assist in removal of air from system 10 by, for example, pumping additional liquid coolant into condenser heat exchanger 22.

It will be noted that the embodiment of FIG. 1 may operate without a refrigeration system. In the context of electronic circuitry, such as may be utilized in structure 12, the absence of a refrigeration system can result in a significant reduction in the size, weight, and power consumption of the structure provided to cool the circuit components of structure 12.

Figure 2:
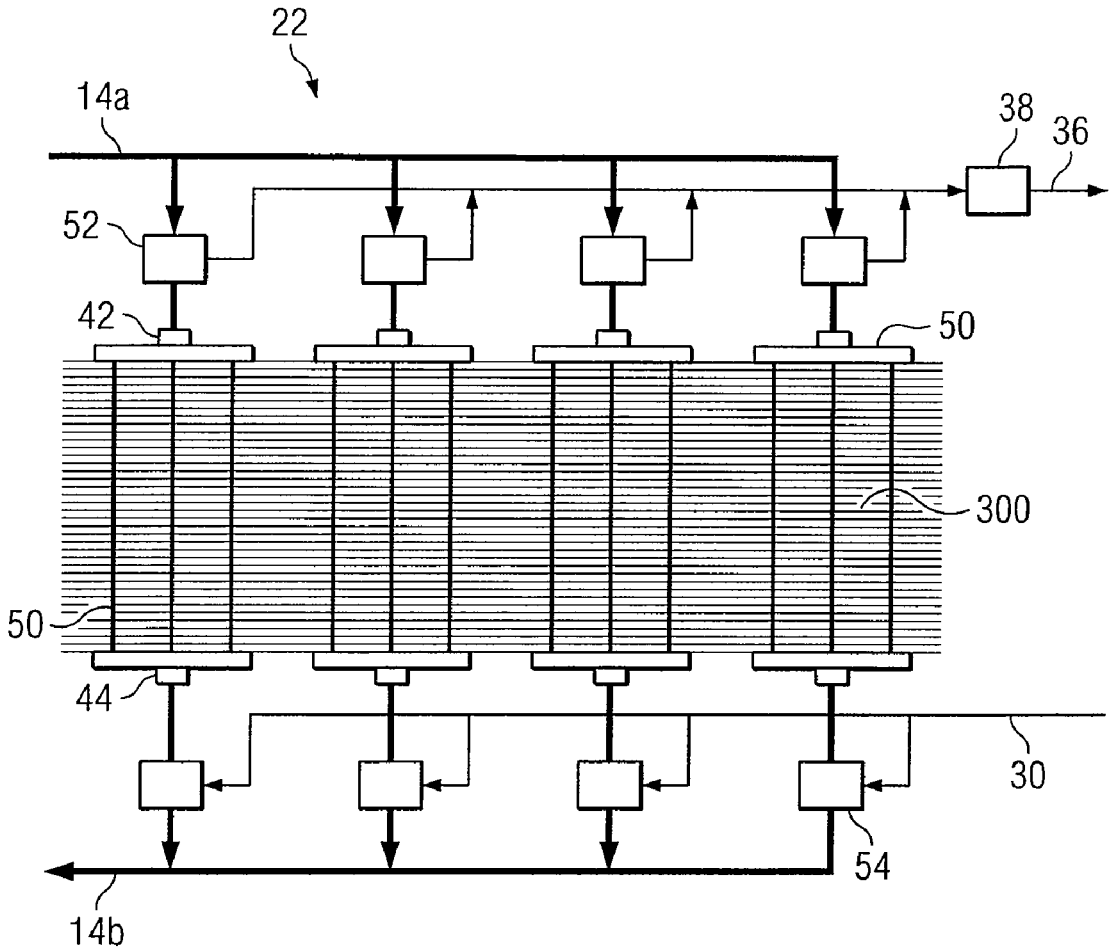
FIG. 2 illustrates one embodiment of a condensing heat exchanger that may be used in the system of FIG. 1.
Figure 2:
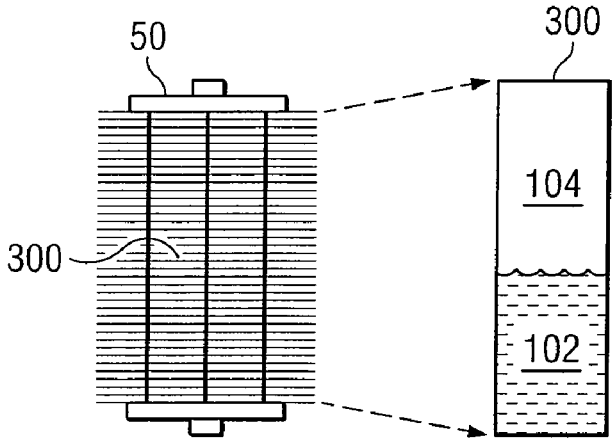

FIG. 2 illustrates additional details of condensing heat exchanger 22 according to certain embodiments. Condensing heat exchanger 22 may include one or more sections 50, each section 50 including one or more tubes 300. Each tube 300 may contain a liquid coolant portion 102 and a vapor coolant portion 104. In certain embodiments, tube 300 may additionally include a volume of non-condensable gas such as in-leakage air. One or more sections 50 may be coupled with air bleed line 36 which includes air bleed valve 38. In certain embodiments, no, one, several, or all of sections 50 include an inlet header 42 and an outlet header 44. In certain embodiments, no, one, several, or all of sections 50 may include an inlet valve 52, an outlet valve 54, and/or a liquid level sensor (not illustrated, described further below). Alternatively, certain embodiments may include multiple condensing evaporators with separate inlet and outlet valves. In certain embodiments, inlet 52 may include a three-way valve operable to allow vapor coolant from line 14 to enter section 50 and/or allow trapped air within section 50 to evacuate via air release line 36. Inlet valve 52 may be coupled with coolant line 14, air bleed line 36, and/or inlet header 42 for section 50. Certain embodiments may include a three-way valve operable to allow liquid coolant to exit from section 50 to line 14*b* and/or allow additional liquid coolant from back fill line 30 to enter section 50. Outlet valve 54 may be coupled to outlet header 44, coolant back fill line 30, and/or coolant loop 14. In certain embodiments, a single section 50 may be coupled with inlet valve 52 and outlet valve 54. In certain embodiments, no, one, several, or all sections 50 may be coupled with an inlet valve 52 and an outlet valve 54.

Teachings of some embodiments of the disclosure recognize an air-removal system for a SACS that compensates for circumstances when the heat sink (e.g., ambient temperature) and heat load reach various levels. In certain embodiments, it may be desirable to maintain a constant boiling point for the fluid coolant regardless of varying heat loads and/or heat sink conditions. As more or less heat is produced, more or less active area within condenser heat exchanger 22 may be needed to condense resulting vapor. Similarly, as the temperature of a heat sink varies (e.g., varying ambient air temperature), more or less active area within condenser heat exchanger 22 may be needed to condense resulting vapor. Pressure within condenser heat exchanger 22 may be used as an indicator of boiling point. In certain embodiments, a boiling point may be held constant by maintaining a constant pressure within condenser heat exchanger 22. Given a controlled boiling point, a varying heat load, and no control over the heat sink, a level of coolant within condenser heat exchanger 22 may be adjusted to control an area of exchanger 22 that can condense vaporized coolant. Accordingly, in certain embodiments, the proper condenser heat exchanger coolant level corresponds to where the active area of a condenser heat exchanger 22 removes a heat load while holding the boiling point at a desired level, represented in the following equation:

$$\dot{Q}=KA(T_{boil}-T_{air})$$

where $\dot{Q}$ represents the rate of heat removal from the vapor and/or fluid, K represents the overall heat transfer coefficient from the vapor and/or fluid to the ambient air, A represents the heat transfer area consistent with the definition of K (e.g., the inside condensing area for the vapor, or the outside cooling air contact area associated with the corresponding inside condensing area), $T_{boil}$ represents the local vapor saturation boiling temperature, and $T_{air}$ represents the ambient air temperature far away from the heat transfer source. Note that A may vary depending on the height of liquid in the heat exchanger.

In certain embodiments, SACS controller 32 may control a level of coolant in the heat exchanger to hold a constant boiling point and control the pressure. In certain embodiments, SACS controller 32 may schedule and sequence tubes associated with a SACS (e.g., discharge tubes in a section(s) of a condensing heat exchanger, or discharge tubes outside a condensing heat exchanger). Certain embodiments teach that SACS controller 32 may schedule on- and off-line service and discharge intervals for tubes and/or sections associated with a SACS. In certain embodiments, SACS controller 32 may additionally smoothly switch in one section or tube as another section or tube is switched out. In certain embodiments, SACS controller 32 may take a section or tube out of service, purge the air from the off-line section or tube, return the section or tube to service, and while returning that section or tube, take another section or tube out of service to purge the air from that section or tube. Certain embodiments teach that controller 32 may control frequency of air-removal sequences. In certain embodiments, controller 32 may determine schedules and/or cycles for air removal based on the ability of on-line tubes or sections to handle a heat load associated with the SACS. Controller 32 may be operable in various embodiments to perform various functions related to controlling the operations and service of a SACS, including the heat exchanger, and any tubes such as discharge tubes.

Figures 3A, 3B, 3C, 3D:
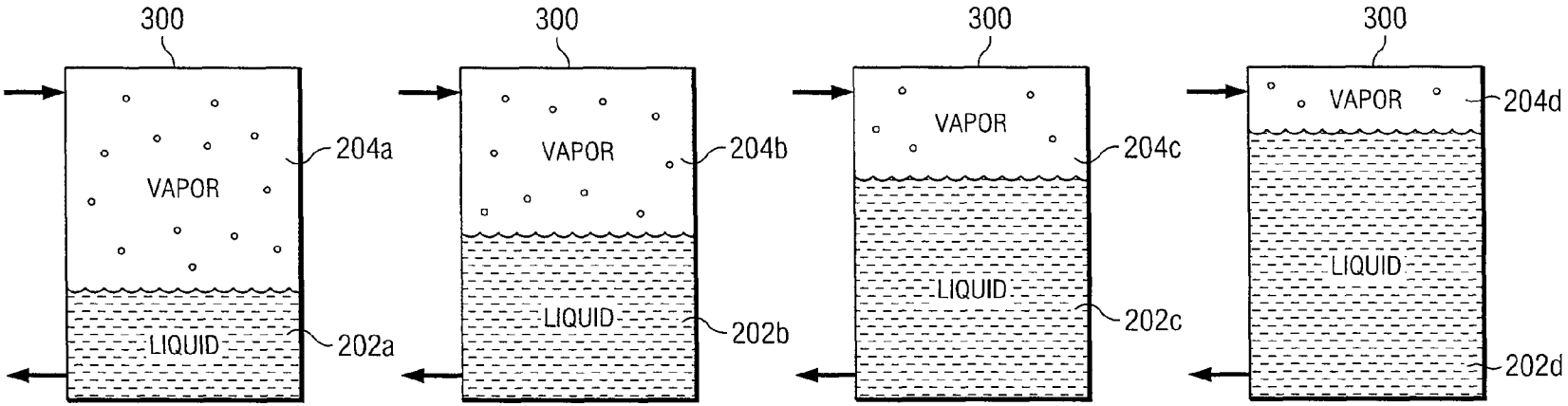
FIGS. 3 and 4 illustrate effects of various examples of operating conditions on the system of FIG. 1 according to certain embodiments.
Figure 4C:
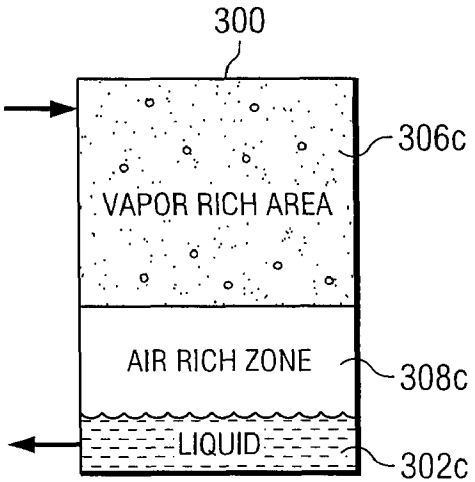
Figure 4C:
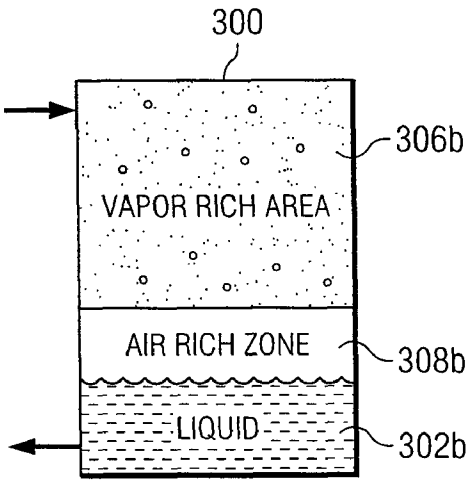
Figure 4C:
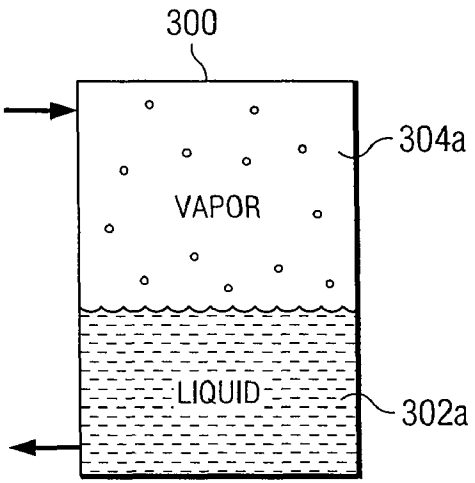
Figure 4C:
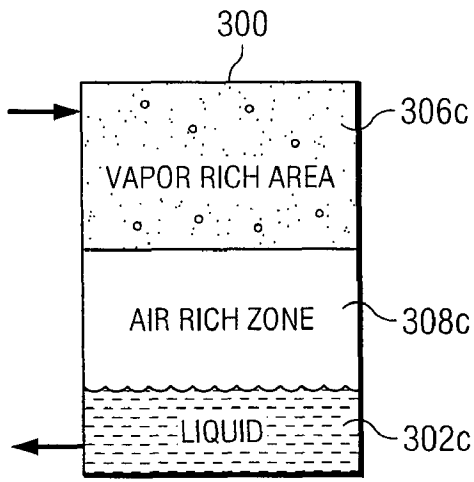
Figure 4B:
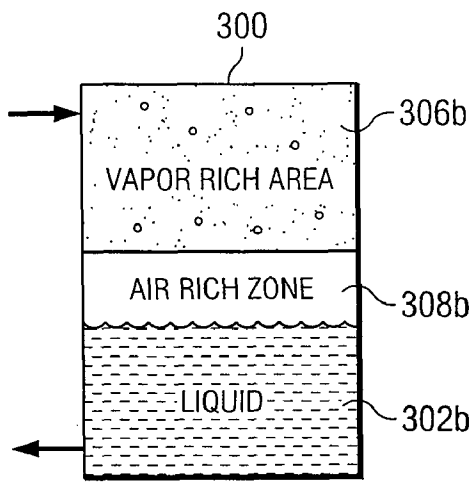
Figure 4A:
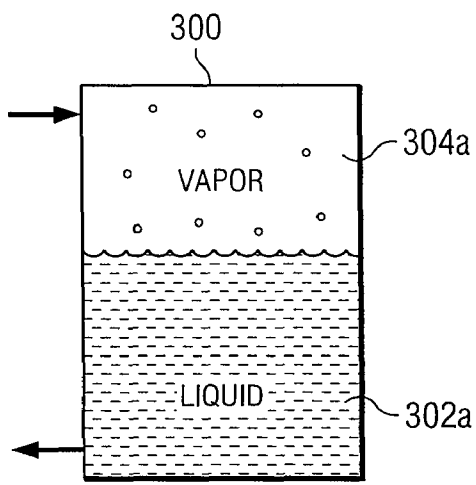

FIG. 3 illustrates certain effects a varying heat load and heat sink may have on an active area within a heat exchanger, according to certain embodiments. Particularly, because a liquid portion 202 does not reject appreciable heat, the level of a vapor portion 204 within condensing heat exchanger tube 300 varies in response to high heat loads and/or heat sink temperatures.

Example A of FIG. 3 illustrates an operation of an embodiment subject to a high heat load and high ambient air temperature (heat sink). Accordingly, in A, a vapor portion 204*a* is (relatively) large and a liquid portion 202*a* is (relatively) small. Conversely, Example D illustrates an operation of an embodiment subject to a low heat load and low ambient air temperature (heat sink), wherein a vapor portion 204*d* is smallest and a liquid portion 202*d* is greatest. Examples B and C illustrate two intermediate examples wherein embodiments contain varying active areas within a heat exchanger corresponding to alternative heat load and heat sink combinations. Although examples A through D illustrate possible operating conditions for condensing heat exchanger 22, it is noted that the functionality of condensing heat exchanger 22 is not limited to these examples.

FIG. 4 illustrates certain effects of a varying heat load on condensing heat exchanger 22 containing in-leakage air. Theoretically, a cooling loop as discussed above should contain only coolant. As a practical matter, however, non-condensable gases such as external air (in-leakage air) may possibly leak into the cooling loop for various reasons such as, for example, damage to the system, aging seals, or fitting leakage. Non-condensable gases can originate from dissolved gases in the initial charge of liquid coolant, or in additional quantities of coolant added to the system from to make up for coolant lost during normal operation. To the extent that non-condensable gases such as air accumulate within the system, they can significantly decrease the heat removal capability and efficiency of the system. Additionally, the presence of such non-condensable gases (i.e., in-leakage air) within the system may affect the coolant level within condensing heat exchanger tube 300.

In the case of a coolant fluid such as water with a density similar to that of in-leakage air, there may be no separation of water vapor and in-leakage air within condensing heat exchanger tube 300. Accordingly, an air rich zone 308 illustrated in FIG. 4 may have no distinct boundary (although a boundary is indicated in FIG. 4 for illustrative purposes), and the size of air rich zone 308 may be unknown. In addition, the location of air rich zone 308 may vary during operation, depending on the liquid level in condensing heat exchanger tube 300. Although FIG. 4 indicates that air rich zone 308 is located between liquid 302 and vapor 204, in various embodiments air rich zone 308 may have a different or dispersed location in tube 300.

In particular, during operation of certain embodiments, vapor coolant may enter at the top of tube 300 in a velocity stream created by condensation at the sidewalls of tube 300. In certain embodiments, in-leakage air trapped in tube 300 may be substantially pushed to below the vapor coolant portion, as the trapped air cannot condense. In-leakage air may thus accumulate in an air rich zone comprising mostly in-leakage air, as well as some vapor coolant. Similarly, vapor coolant within tube 300 may accumulate in a vapor rich area comprising mostly vapor coolant, as well as some in-leakage air. As can be seen in FIG. 4, the location of an air rich zone 308 within tube 300 may change with varying heat loads, heat sinks, and amount of in-leakage air. Consider Examples B and C of FIG. 4, which illustrate that given a portion of in-leakage air within tube 300, a varying heat load will change the location and/or size of air rich zone 308. Accordingly, at a given point in time, the location and/or size of air rich zone 308 may be unknown. It should be noted that one advantage of certain embodiments is that in-leakage air may be removed from tubes 300 regardless of the location and/or size of air-rich zone 308.

Accordingly, certain disclosed embodiments provide for a system for removing non-condensable gases from cooling system under changing and varied operating conditions. Teachings of some embodiments of the disclosure recognize an air-removal system that accounts for variable heat loads, variable heat sinks, and/or an unknown volume of in-leakage air within a condensing heat exchanger. Certain embodiments recognize cooling systems wherein components with internal cooling passages may be removed, replaced, or installed without the need to manually purge in-leakage air from the cooling loop. Certain embodiments recognize an automated system for removing in-leakage air from a cooling system.

Figures 5A, 5B, 5C, 5D, 5E:
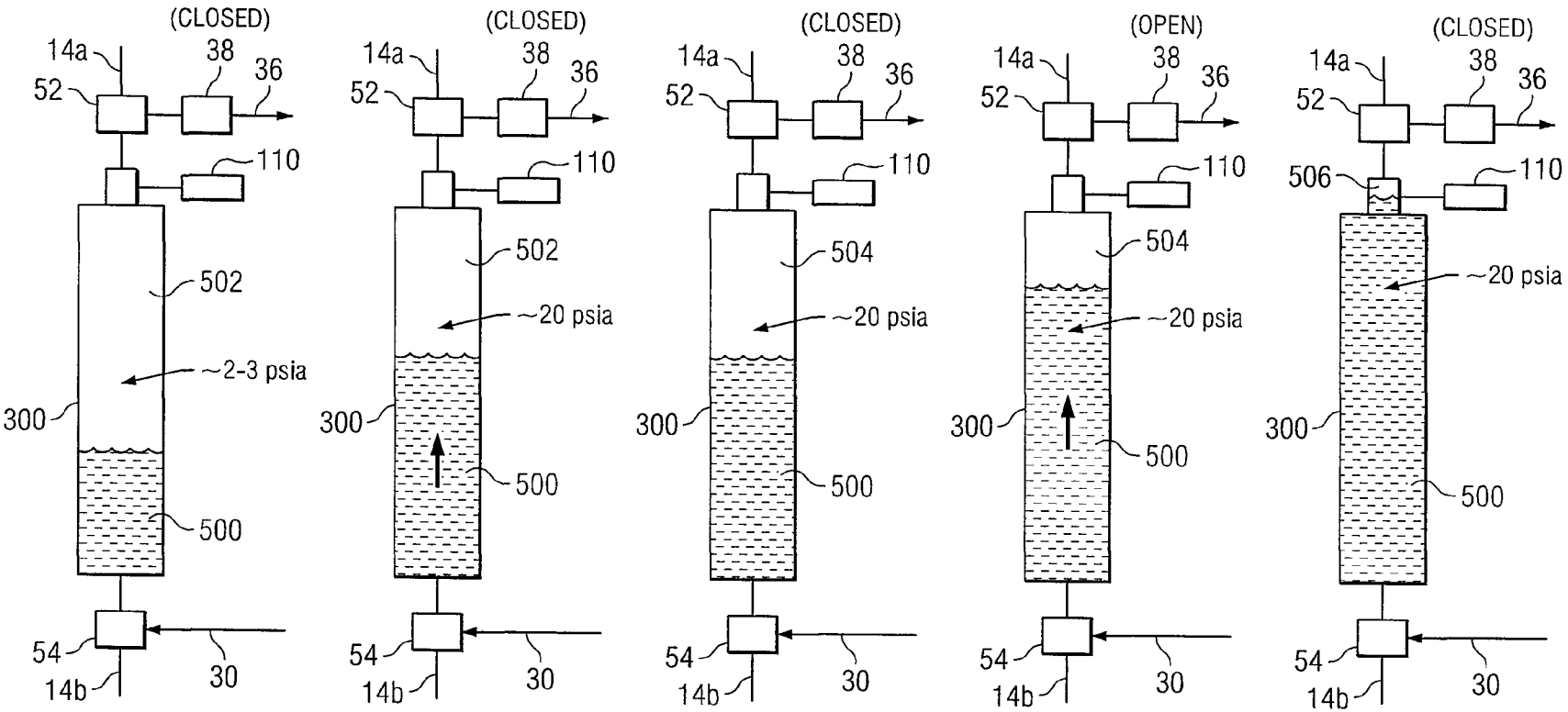
FIG. 5 illustrates a process for removing non-condensable gas from the system of FIG. 1 according to certain embodiments.

FIG. 5 illustrates the operation of one embodiment for removing non-condensable gases from a SACS. Condenser heat exchanger tube 300 includes inlet valve 52 coupled to coolant line 14*a*, air release line 36, and tube 300. Outlet valve 54 is coupled to pressurized back fill line 30, coolant line 14*b*, and tube 300. A back fill pump (not pictured) for pressurized back fill line 30 may be selectively actuated and deactuated by level switch 110. Level switch 110 is disposed at approximately the level of the top surface the liquid coolant should be permitted to reach within tube 300. To the extent that non-condensable gases such as air may progressively leak into the system over time, they will take up a progressively increasing amount of room in an upper portion of tube 300. As explained above, the contents of tube 300 may include liquid coolant 500 as well as a volume 502 containing both vapor and in-leakage air.

Tube 300 may in certain embodiments be a tube located within a condensing heat exchanger. Alternatively, tube 300 may be a separate discharge tube located outside a condensing heat exchanger. No, one, several, or all tubes within a condensing heat exchanger may be discharge tubes. In certain embodiments, a particular number of tubes within a heat exchanger are discharge tubes and operate to remove air from the SACS as a whole. Additionally, in certain embodiments, a condensing heat exchanger may contain discharge tubes in certain sections. For example, in certain embodiments, one section may include discharge tubes for air removal, and three sections may be nondischarge tubes for condenser heat exchanger operation. In certain embodiments, one or more tubes in one, some or all sections within a condensing heat exchanger may be discharge tubes. For example, in certain embodiments, a condensing heat exchanger may contain four sections, each section having four tubes, wherein some, none, or all the tubes in the sections are discharge tubes. In certain embodiments, one or more sections associated with discharge tubes may be cycled on- and off-line to remove air from a SACS, while other section(s) remain on-line. In particular embodiments, multiple sections may include a discharge tube, and in certain embodiments, multiple sections may be cycled on- and off-line for air removal.

One or more sections including one or more discharge tubes may be located outside the condenser heat exchanger in certain embodiments. In particular embodiments, one or more discharge tubes located outside the condenser heat exchanger may be devoted to air removal. For example, in one embodiment, a condensing heat exchanger may have a plurality of non-discharge tubes, and one or more discharge tubes located outside the condensing heat exchanger may operate to remove noncondensable gas from all tubes in the SACS. Certain embodiments may have particular tubes equipped as discharge tubes to reduce system cost, weight, and complexity by, for example, minimizing the number of valves and sensors.

Step A of FIG. 5 represents a state of tube 300 during normal operation of a SACS. Tube 300 contains liquid coolant 500 and volume 502 comprising a mixture of coolant vapor and in-leakage air. As can be seen, during normal operation of certain embodiments, the pressure within tube 300 may be approximately 2-3 psia. It should be noted that where a plurality of tubes operate in a SACS, each tube within each section may operate in substantial equilibrium and contain approximately equal amounts of coolant liquid, coolant vapor, and in-leakage air, regardless of whether each tube is a discharge tube or a non-discharge tube, and without regard for whether each tube is located within a condensing heat exchanger or outside a condensing heat exchanger.

Step B of FIG. 5 represents tube 300 wherein inlet valve 52 has been closed to block in-flow of coolant vapor from line 14*a*. Air bleed valve 36, here a two-way valve, is also closed at step B, and outlet valve 54 is closed to block flow to coolant line 14*b*. Liquid coolant 500 and volume 502 are trapped within tube 300. While tube 300 is segregated in this manner, exposure to the heat sink (e.g., ambient air) continues and trapped coolant vapor within tube 300 will condense as thermal energy passes to the heat sink. In certain embodiments, outlet valve 54 may be opened to allow additional liquid coolant 500 to flow into the bottom of tube 300 via coolant back fill line 30. In alternative embodiments, valve 54 may be opened partially or left closed as condensation continues. As noted, thermal energy passes to the heat sink, causing vapor coolant in tube 300 to condense. Condensation may be assisted by allowing additional liquid coolant 500 to flow into the bottom of tube 300 to increase pressure of trapped volume 502, further enhancing transfer of thermal energy to the heat sink. Pressure within tube 300 increases as liquid coolant is allowed to run into the bottom of tube 300, expediting condensation of the vapor portion.

Step C illustrates a state of tube 300 after substantially all vapor coolant within volume 502 has condensed, leaving substantially only liquid coolant 500 and in-leakage air 504 trapped within tube 300.

At step D, air bleed valve 38 may then be opened to allow trapped in-leakage air 504 to be pushed out through air release line 36 by the rising pressurized liquid coolant 500. Liquid sensor 110 detects when liquid coolant 500 reaches a predetermined level and, as illustrated in step E, causes air release valve 38 to close once substantially all trapped in-leakage air 504 has been pushed out of tube 300, leaving only ullage air 506 within tube 300. Tube 300 may then be put back into service in condensing heat exchanger 22.

In certain embodiments, liquid level sensor 110 is disposed at or near the highest desirable level for liquid coolant within a discharge tube. Liquid level sensor 110 may, in certain embodiments, detect when liquid coolant reaches a predetermined level and, in response to such a detection, cut off a flow of liquid coolant into the tube or tubes associated with the sensor. Additionally, other known methods may be used for detecting when a coolant level has reached a predetermined level within a tube and accordingly cutting off additional liquid flow into the tube. Subsequently, tube 300 may be restored to operation or, if non-operable, allowed to return to a state of equilibrium relative to other tubes in a SACS (whether inside or outside a condensing heat exchanger). In certain embodiments, any part or whole of the process described may be repeated for another tube 300, or for another section of tubes. In certain embodiments, any part of the process may be performed with respect to a single tube, a plurality of tubes, a single section among a plurality of sections, a plurality of sections among a plurality of sections, or any practicable combination with regard to analogous components of a SACS.

In certain embodiments, SACS controller 32 of system 10 controls the level of coolant in condensing heat exchanger 22 to hold a constant boiling point by controlling the pressure. SACS controller 32 may additionally schedule and sequence air removal from condensing heat exchanger sections according to any number of timing schedules. SACS controller 32 may also control on- and off-line switching transitions to smoothly switch sections in and out, controlling the loop and preventing large pressure spikes. The steps of FIG. 5 may be performed on a single tube or section within a condenser heat exchanger while other sections continue normal operation, or may be performed on multiple tubes or sections simultaneously while other tubes or sections continue normal operation. Accordingly, the disclosed methods for air removal may be performed in real time operation of a SACS without disrupting SACS operation. Additionally, as can be seen, certain embodiments also provide for removing air from a SACS without removing a substantial amount of vapor coolant, thereby conserving materials and increasing efficiency of the SACS. Certain embodiments provide an air removal system and method which accommodates a varying level of liquid coolant with a condensing heat exchanger, thereby unaffected by varying heat loads and varying ambient conditions.

In certain embodiments, condenser heat exchanger 22 may include a plurality of sections 50 which do not include functionality for removing air according to the described method. In certain embodiments, a single section devoted to air removal may include means for implementing the air removal methods mentioned in the disclosure.

In certain embodiments, the steps described above may be implemented in a off-line batch-process for one or more sections. For example, in certain embodiments wherein condenser heat exchanger 22 includes seven sections 50, six of the sections 50 may continue normal SACS operation while a single section 50 may be taken off-line to be emptied of in-leakage air according to the described methods. Alternatively, in certain embodiments, two sections at a time may be taken off-line for air removal. In certain embodiments, any number of sections may be taken off-line at a time for air removal, provided that remaining on-line sections are sufficient to handle the heat load applied to the SACS. Examples given are for illustrative purposes only, and the methods and systems disclosed contemplate and any number of timing sequences and/or combinations which may be performed for air removal.

Certain embodiments may include a section and/or one or more tubes devoted to air removal processes for the SACS but do not function as evaporators. For example, in certain embodiments, a separate section 22 may include a plurality of devoted air removal tubes which do not function as evaporators in parallel with normally operating condensing heat exchanger tubes such that the non-functioning section will equalize with heat exchanging tubes or sections. Because in-leakage air is distributed and redistributed in a substantially uniform manner among the sections, the devoted air removal section may be repeatedly taken off-line, emptied of in-leakage air, and replaced in-line to remove in-leakage air from an entire SACS system, and/or tubes or sections of condensing heat exchanger 22.

In certain embodiments, less than all the tubes within condensing heat exchanger 22 may be equipped for air removal according to the described methods. Accordingly, such embodiments may reduce costs and size while increasing efficiency. For example, in such embodiments, the number of valves, sensors, and couplings may be reduced without sacrificing performance of the air-removal system.

Numerous other changes, substitutions, variations, alterations, and modifications may be ascertained by those skilled in the art as intended that the present invention encompass all such changes, substitutions, variations, alterations, and modifications as falling within the spirit and scope of the appended claims. Moreover, the present invention is not intended to be limited in any way by any statement in the specification that is otherwise reflected in the claims.

What is claimed is:

1. A method for removing non-condensable gas from a cooling system, comprising:

trapping contents of a discharge tube using one or more valves associated with the discharge tube, the discharge tube being associated with a plurality of tubes of a heat exchanger, the heat exchanger in thermal communication with an ambient environment at an ambient temperature, the contents of the discharge tube comprising a vapor portion of a cooling fluid, a liquid portion of the cooling fluid, and a volume of non-condensable gas, the cooling fluid at a subambient pressure, the ambient temperature lower than a boiling point of the cooling fluid;

inletting, using the one or more valves, a first additional portion of the cooling fluid into the discharge tube to increase a pressure within the discharge tube;

allowing, using the one or more valves, the vapor portion of the cooling fluid within the discharge tube to condense; and inletting, using the one or more valves, a second additional portion of the cooling fluid to purge the non-condensable gas from the discharge tube.

2. The method of claim 1, further comprising allowing the discharge tube to at least approach thermal equilibrium with the plurality of tubes of the heat exchanger.

3. The method of claim 1, wherein the plurality of tubes comprises the discharge tube.

4. The method of claim 1, further comprising:

trapping contents of a second discharge tube associated with the plurality of tubes of the heat exchanger, the contents of the second discharge tube comprising a second vapor portion of the cooling fluid, a second liquid portion of the cooling fluid, and a second volume of non-condensable gas;

inletting a third additional portion of the cooling fluid into the second discharge tube to increase a second pressure within the second discharge tube;

allowing the second vapor portion of the cooling fluid within the second discharge tube to condense; and inletting a fourth additional portion of the cooling fluid to purge the second volume of non-condensable gas from the discharge tube.

5. The method of claim 4, wherein respective steps related to the discharge tube and the second discharge tube are performed substantially simultaneously.

6. The method of claim 1, wherein trapping the contents of the discharge tube comprises closing a three-way valve disposed near a first end of the discharge tube.

7. The method of claim 1, wherein inletting the first additional portion of the liquid cooling fluid comprises:

opening a three-way valve disposed at an end of the discharge tube; and inletting the first additional portion of the liquid cooling fluid using a pump.

8. The method of claim 1, wherein:

the subambient pressure is approximately two to three psia; and the increased pressure resulting from the inletting is approximately 14-20 psia.

9. The method of claim 1, wherein the cooling fluid comprises water.

10. The method of claim 1, wherein the cooling fluid comprises water and an additional fluid providing antifreeze protection.

11. A system for removing non-condensable gas from a cooling system, comprising:

a discharge tube associated with a plurality of tubes of a heat exchanger, the heat exchanger in thermal communication with an ambient environment at an ambient temperature, the contents of the discharge tube comprising a vapor portion of a cooling fluid, a liquid portion of the cooling fluid, and a volume of non-condensable gas, the cooling fluid at a subambient pressure, the ambient temperature lower than a boiling point of the cooling fluid; and one or more valves associated with the discharge tube, the one or more valves configured to:

trap the contents of the discharge tube;

inlet a first additional portion of the cooling fluid into the discharge tube to increase a pressure within the discharge tube;

allow the vapor portion of the cooling fluid within the discharge tube to condense; and inlet a second additional portion of the cooling fluid into the discharge tube to purge the non-condensable gas.

12. The system of claim 11, wherein the one or more valves are further configured to allow the discharge tube to at least approach thermal equilibrium with the plurality of tubes of the heat exchanger.

13. The system of claim 11, wherein the plurality of tubes comprises the discharge tube.

14. The system of claim 11, further comprising:

a second discharge tube associated with the plurality of tubes of the heat exchanger, contents of the second discharge tube comprising a second vapor portion of the cooling fluid, a second liquid portion of the cooling fluid, and a second volume of non-condensable gas; and an additional one or more valves associated with the second discharge tube, the additional one or more valves configured to:

trap contents of a second discharge tube;

inlet a third additional portion of the cooling fluid into the second discharge tube to increase a second pressure within the second discharge tube;

allow the second vapor portion of the cooling fluid within the second discharge tube to condense; and inlet a fourth additional portion of the cooling fluid to purge the second volume of non-condensable gas.

15. The system of claim 14, wherein the one or more valves and the additional one or more valves operate substantially simultaneously.

16. The system of claim 11, wherein:

at least one of the one or more valves associated with the discharge tube is a three-way valve configured to prevent an additional vapor portion of the cooling fluid from entering the discharge tube; and at least one of the one or more valves associated with the discharge tube is a two-way valve configured to release non-condensable gas trapped in the discharge tube.

17. The system of claim 11, further comprising a pump configured to assist with inletting the additional portions of the cooling fluid.

18. The system of claim 11, wherein:

the subambient pressure is approximately two to three psia; and the increased pressure resulting from the inletting is approximately 14-20 psia.

19. The system of claim 11, wherein the cooling fluid comprises water.

20. The system of claim 11, wherein the cooling fluid comprises water and an additional fluid providing antifreeze protection.

21. A system for removing in-leakage air from a cooling system, comprising:

a discharge tube associated with a plurality of tubes of a heat exchanger, the heat exchanger in thermal communication with an ambient environment at an ambient temperature, contents of the discharge tube comprising a vapor portion of a cooling fluid, a liquid portion of the cooling fluid, and a volume of non-condensable gas, the cooling fluid at a subambient pressure, the ambient temperature lower than a boiling point of the cooling fluid;

one or more three-way valves coupled to the discharge tube;

a liquid level sensor coupled to the discharge tube configured to detect when the liquid portion of the cooling fluid reaches a predetermined level within the discharge tube; and a system controller configured to control the one or more three-way valves and the liquid level sensor to:

trap the contents of the discharge tube;

inlet a first additional portion of the cooling fluid into the discharge tube, increasing a pressure within the discharge tube;

allow the vapor portion of the cooling fluid within the discharge tube to condense;

inlet a second additional portion of the cooling fluid to purge the non-condensable gas from the discharge tube;

detect the liquid portion of the cooling fluid reached the predetermined level within the discharge tube; and restore the discharge tube to thermal equilibrium with the plurality of tubes.

22. The system of claim 21, wherein:

the discharge tube comprises one of the plurality of tubes;

the subambient pressure is approximately two to three psia; and the increased pressure resulting from the inletting the first addition portion of liquid cooling fluid is approximately 14-20 psia.

* * * * *